US005422432A

United States Patent [19]

Lace

[11] Patent Number: 5,422,432

[45] Date of Patent: Jun. 6, 1995

[54] ELECTROMAGNETIC PICKUP FOR A PLURAL-STRING MUSICAL INSTRUMENT INCORPORATING A COIL AROUND A MULTI-LAMINATE FERROMAGNETIC CORE

[75] Inventor: Melvin A. Lace, 3 Garden Ct., Prospect Heights, Ill. 60070

[73] Assignees: Thomas E. Dorn, Chicago; Melvin A. Lace, Clarendon Hills, both of Ill. ; a part interest

[21] Appl. No.: 202

[22] Filed: Jan. 4, 1993

Related U.S. Application Data

[63] Continuation-in-part of Ser. No. 764,346, Sep. 23, 1991, abandoned, and a continuation-in-part of Ser. No. 900,485, Jun. 18, 1992, each is a continuation-in-part of Ser. No. 597,899, Oct. 10, 1990, abandoned.

[51] Int. Cl.[6] ..... G10H 3/18

[52] U.S. Cl. ..... 84/726

[58] Field of Search ..... 84/723, 725–729, 84/743

[56] References Cited

U.S. PATENT DOCUMENTS

| | | |
|---|---|---|
| 2,089,171 | 8/1937 | Beauchamp . |
| 2,896,491 | 7/1959 | Lover . |
| 3,066,567 | 12/1962 | Kelley . |
| 3,183,296 | 5/1965 | Meissner . |
| 3,236,930 | 2/1966 | Fender . |
| 3,571,483 | 3/1971 | Davidson . |
| 3,588,311 | 6/1971 | Zoller . |
| 3,902,394 | 9/1975 | Stich . |
| 3,916,751 | 11/1975 | Stich . |
| 3,983,778 | 10/1976 | Bartolini . |
| 4,026,178 | 5/1977 | Fuller . |
| 4,133,243 | 1/1979 | DiMarzio . |
| 4,145,944 | 3/1979 | Helpinstill . |
| 4,268,771 | 5/1981 | Lace . |
| 4,320,681 | 3/1982 | Altilio . |
| 4,442,749 | 4/1984 | DiMarzio . |
| 4,501,185 | 2/1985 | Blucher . |
| 4,809,578 | 3/1989 | Lace . |
| 4,852,444 | 8/1989 | Hoover et al. . |
| 4,878,412 | 11/1989 | Resnik . |
| 5,072,646 | 12/1991 | Valkama . |

*Primary Examiner*—William M. Shoop, Jr.
*Assistant Examiner*—Jeffrey W. Donels
*Attorney, Agent, or Firm*—Dorn, McEachran, Jambor & Keating

[57] ABSTRACT

An electromagnetic pickup for a musical instrument, such as a guitar, strung with ferromagnetic strings, comprises an elongated laminated ferromagnetic (steel) core long enough to span all of the strings; there are at least four and usually six thin steel laminations in the core. An electrical pickup coil is wound in a coil form, usually plastic, that encompasses the core, and a vertically magnetized main permanent magnet engages the bottom edge of the core. The magnet is preferably formed of a resin impregnated with magnetic particles, is magnetized transversely, and maintains the core at a given polarity. A housing encloses the core, the coil, and the main magnet and provides for mounting the pickup in spaced relation to the strings so that the magnetic field encompasses the strings and string movement generates electrical signals to the coil. Preferably, there are additional permanent magnets to shield the sides of the core. Dual-coil humbucker embodiments of the pickup are described.

12 Claims, 3 Drawing Sheets

ELECTROMAGNETIC PICKUP FOR A PLURAL-STRING MUSICAL INSTRUMENT INCORPORATING A COIL AROUND A MULTI-LAMINATE FERROMAGNETIC CORE

This application is a continuation-in-part of prior application Ser. Nos. 07/764,346 filed Sep. 23, 1991 and 07/900,485 filed Jun. 18, 1992, which are continuations-in-part of Ser. No. 07/597,899 filed Oct. 10, 1990.

Application Ser. Nos. 07/764,346 and 07/597,899 have been abandoned.

BACKGROUND OF THE INVENTION

For many years, electromagnetic signal pickups have been utilized on musical instruments having ferromagnetic strings. Such pickups have been employed with guitars, bass guitars, banjos, mandolins, and a variety of other instruments. A pickup for a musical instrument that uses ferromagnetic strings almost invariably incorporates a magnetic structure for generating a magnetic field that encompasses the strings. That magnetic structure usually includes at least one permanent magnet and at least one high-permeability pole piece. Frequently, the pickup has a separate pole piece or permanent magnet for each string; thus, a guitar pickup may have six pole pieces or six magnets, one for each string. On the other hand, some electromagnetic pickups have a single pole piece that spans a number of strings, often all of the strings of the instrument. The pickup may have an electrical pickup coil for each string, or it may have one electrical pickup coil that generates a composite all-string signal. The electrical signals from the coil or coils are amplified and reproduced by a speaker or other transducer as the output of the musical instrument. The electrical pickup coils are customarily disposed in encompassing relation to the magnetic cores; when there are plural coils each coil usually has its own core. This relatively simple electromagnetic structure is fitted into a housing. The housing may or may not be part of the magnetic structure. Whether or not it is a part of the magnetic structure, a principal purpose of the housing is to protect the pickup from dirt and other contaminants.

A wide variety of individual constructions have been used for electromagnetic pickups employed with musical instruments such as guitars. Frequently, the efforts of the pickup designer have been directed toward achieving an output signal from the electrical coil that is as close as possible to a faithful reproduction of the sound that would be developed by the instrument functioning as an acoustical device. This is not always the case, however; many electromagnetic pickups have been designed to give a particular distortion deemed desirable by the designer or by a musician.

For electromagnetic pickups in general, as applied to musical instruments having steel or other ferromagnetic strings, there may be some difficulty in obtaining an output signal of sufficient amplitude. This may be a minor problem, with modern electronic technology, because even a very weak signal can often be amplified to an adequate amplitude. On the other hand, a reasonable output amplitude from the pickup itself is desirable because it reduces the necessity for subsequent amplification, and thus reduces the likelihood of inadequately controlled distortion. Moreover, with adequate initial amplitude of the signal generated by the pickup, the signal-to-noise ratio is increased so that a "purer" signal can be realized.

A pronounced problem, in many electromagnetic pickups for musical instruments, has to do with the frequency response. The overall "sound" derived from the output signal is usually critical to the requirements of the musician. Some musicians want to have the output signal as close as possible to the acoustic output of the instrument, at least in theory. Others, however, want to have a distortion that is acceptable to them, one that represents their own concept or technique for interpretation of music. The frequency response characteristics of the pickup are critical in this regard. A similar situation is presented by the sound characteristic known to musicians as "sustain"; sometimes accented "sustain" is desirable in the view of the musician using the pickup and sometimes it is not.

SUMMARY OF THE INVENTION

It is a primary object of the invention, therefore, to provide a new and improved electromagnetic pickup, for a musical instrument having a plurality of ferromagnetic strings, which affords improved initial amplitude and signal-to-noise ratio and that can generate signals having a broad range of frequency and "sustain" characteristics.

A specific object of the invention is to provide a new and improved electromagnetic pickup for a plural ferromagnetic stringed musical instrument that affords a high amplitude output signal, despite substantial variations in the construction and operation of the pickup itself, and that can produce a variety of different frequency effects in its output signal.

A specific object of the invention is to provide a new and improved electromagnetic pickup for a plural ferromagnetic stringed instrument, particularly a guitar, that is simple and inexpensive in construction, that can be readily mounted upon the guitar, and that has a virtually indefinite life.

Accordingly, the invention relates to an electromagnetic pickup for a musical instrument, such as a guitar, having a plurality of ferromagnetic strings disposed in substantially co-planar spaced relation to each other over a predetermined span S; the pickup comprises an elongated ferromagnetic core, having a length L larger than S and a substantially smaller height, the core including an assembly of a plurality of at least four thin, matching sheets of ferromagnetic material (steel) aligned with each other. An electrical pickup coil is disposed in encompassing relation to the core; main permanent magnet means are provided, including a main permanent magnet disposed in engagement with one elongated edge of the core and magnetized in a direction transverse to the core height, for maintaining a given constant polarity in the core. The pickup includes a housing encompassing the core, the coil, and the permanent magnet means; the housing is used for mounting the pickup in the musical instrument with the core and coil spanning the ferromagnetic strings in spaced relation thereto and with the strings passing through a constant magnetic field afforded by the main permanent magnet and the core so that movement of any string generates an electrical signal in the coil.

DESCRIPTION OF THE PREFERRED EMBODIMENTS

Figure 1:
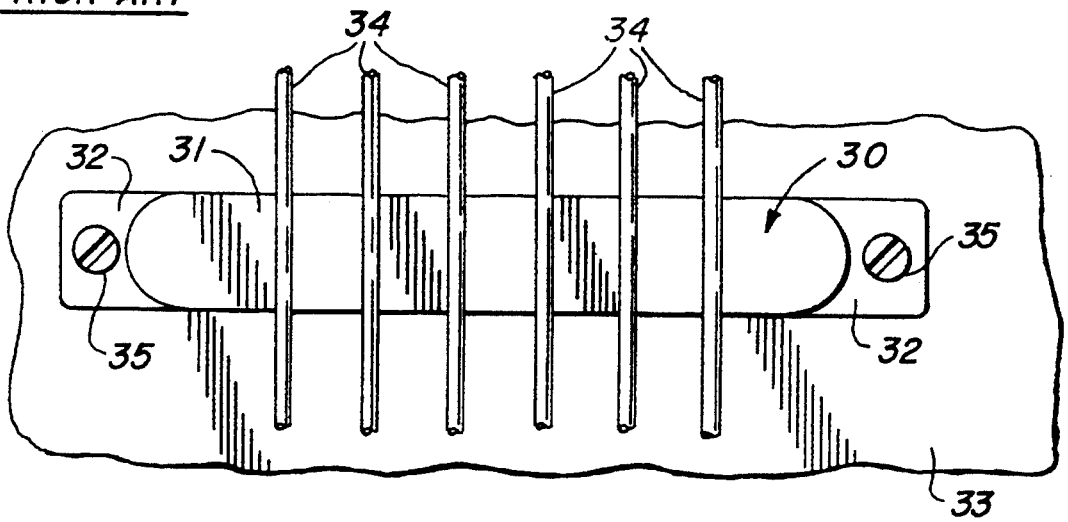
FIG. 1 PRIOR ART
FIG. 1 is a plan view of an electromagnetic musical pickup, specifically a guitar pickup, of the kind to which the invention is directed.
Figure 2:
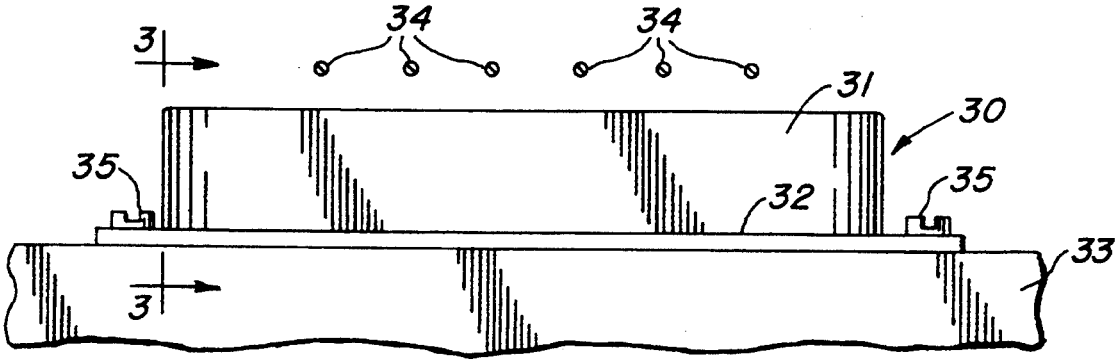
FIG. 2 PRIOR ART
FIG. 2 is a side elevation view of the apparatus of FIG. 1.
Figure 3:
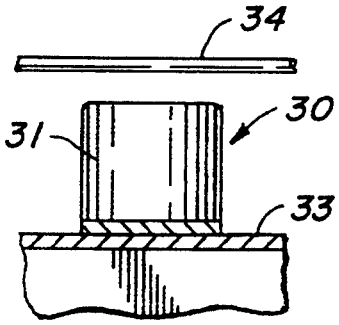
FIG. 3 PRIOR ART
FIG. 3 is a section view taken approximately along line 3—3 in FIG. 2.

FIGS. 1–3 illustrate an electromagnetic guitar pickup 30 that may be deemed generally representative of prior art pickups but that also applies to the electromagnetic musical pickups of the present invention. Typically, pickup 30 comprises a housing 31 having a base plate 32 that may be integral with the housing. Housing 31 may be of steel if it is used as an operating component of pickup 30; the housing may be of plastic if it is not a working electromagnetic component of the pickup. Pickup 30 is mounted on the top 33 of a musical instrument having a plurality of ferromagnetic strings 34. As illustrated, strings 34 are the strings of a guitar and extend across but in spaced relation to the top surface 33 of the guitar neck or body, depending upon where the pickup 30 is mounted. Strings 34 are distributed across a span S, FIG. 1, usually with approximately equal spacing between strings. Appropriate mounting devices 35 are utilized to mount pickup 30 on guitar body 33.

A wide variety of different electromagnetic sensing devices have been utilized in prior art embodiments of pickup 30; consequently, no specific pickup structure is shown in FIGS. 1–3. On the other hand, it may be noted that any known construction for electromagnetic pickup 30 would include a magnetic structure for generating a magnetic field that encompasses in part, the ferromagnetic strings 34. A structure of this sort, in any of the known prior art devices, customarily includes at least one permanent magnet and may include at least one high permeability ferromagnetic pole piece. For the electromagnetic pickup 30 shown in FIGS. 1–3, utilizing known constructions, there could be six pole pieces, or six magnets, one for each string 34. On the other hand, some forms of electromagnetic pickup have utilized a single pole piece that extends the length of the pickup, beneath all of the musical strings 34.

In any of the known forms of electromagnetic pickup there is at least one electrical pickup coil, not shown in FIGS. 1–3; there may be separate coils for each of the strings 34, usually with all of those coils electrically connected together. The entire pickup construction, including the pole piece or pieces, the permanent magnet or magnets, and the electrical pickup coil or coils, is disposed in housing 31. Vibrations of the musical instrument strings 34, both vertically and horizontally, generate electrical signals in the coil or coils within housing 31i and it is those signals that are amplified and reproduced, as by one or more speakers, to afford an output from the musical instrument in conventional manner.

Figure 4:
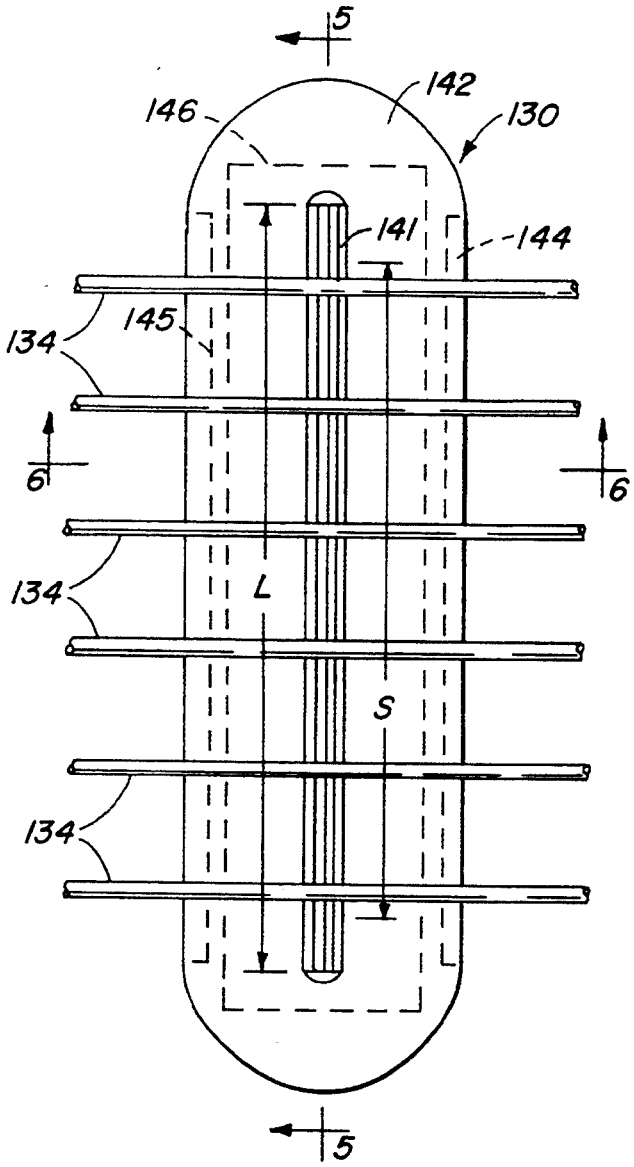
FIG. 4 is a plan view of an electromagnetic musical pickup, specifically a guitar pickup, constructed in accordance with one embodiment of the invention.
Figure 5:
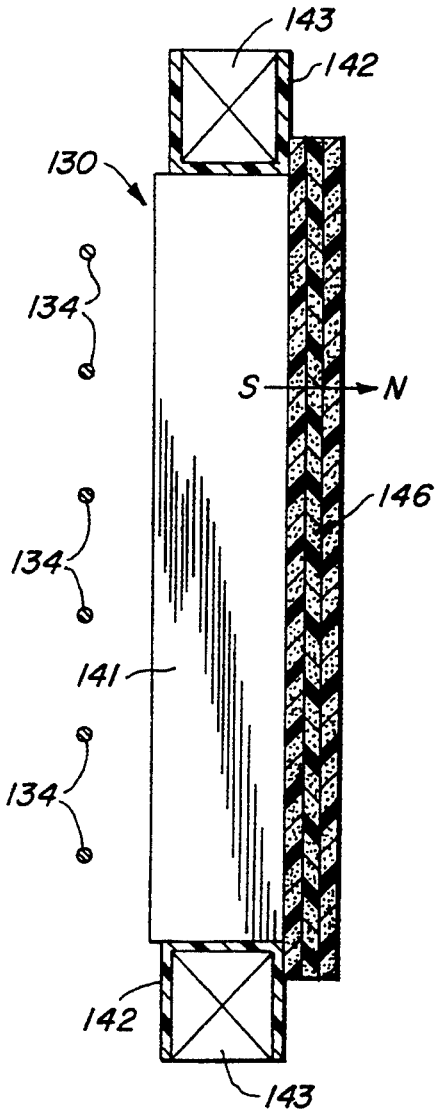
FIG. 5 is a longitudinal sectional view taken approximately along line 5—5 in FIG. 4.
Figure 6:
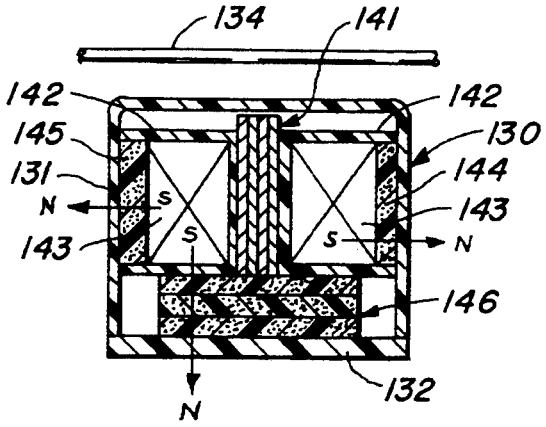
FIG. 6 is a transverse sectional view taken approximately along line 6—6 in FIG. 4.

FIGS. 4–6 illustrate the operating components of an electromagnetic-musical pickup 130 constructed in accordance with one embodiment of the present invention. Pickup 130 includes an elongated central ferromagnetic core 141 that extends for a length L that is larger than the string span S. Thus, core 141 spans all of the ferromagnetic strings 134 of the musical instrument. In this instance, it is assumed that pickup 130 is used for a six string guitar. As illustrated, there are four thin sheet steel laminations in core 141. Typically, however, the number of laminations may vary; six or even eight thin steel laminations are frequently utilized. A coil form 142 is mounted on the central laminated core 141 and an electrical pickup coil 143 is mounted in coil form 142, thus being disposed in encompassing relation to core 141. Pickup coil 143 generates an electrical signal representative of movements of strings 134.

Two elongated permanent magnets 144 and 145 are mounted in the outer edges of coil form 142; they extend along the opposite sides of the coil form and coil 143 (FIGS. 4 and 6). Permanent magnet 144 is magnetized so that its entire interior surface facing coil 143 is a south pole. Magnet 145, on the other hand, is magnetized in the opposite direction so that its interior surface facing coil 143 also constitutes a continuous south pole. Permanent magnets 144 and 145 are used primarily as shields for coil 143; however, they do tend to modify the frequency response of pickup 130 and to increase the amplitude of its output signal.

The lower elongated edge of laminated steel core 141 engages the top surface of a main permanent magnet 146; the main permanent magnet 146 is shown as constructed of three layers of permanent magnet material, but this is done only because the preferred permanent magnet materials referred to below are commercially available in thin sheets. Main magnet 146 could be of unitary construction. All layers of permanent magnet 146 are magnetized in the same direction, transverse to the height of core 141, thus affording a continuous south pole facing upwardly of magnet 146 and engaging the lower edge surface of the laminated core 141. The entire pickup 130 may be encompassed in a housing 131, supported upon a base 132. Housing 131 and base 132 may constitute plastic moldings, since the housing is not a part of the magnetic structure in pickup 130.

The preferred permanent magnet material, for shield magnets 144 and 145 as well as the main magnet 146, comprises a resin material, preferably relatively flexible and slightly elastomeric, that is impregnated with particulate permanent magnet material. Such permanent magnet resin sheets are readily available commercially. One form of flexible permanent magnet resin material is made and sold by 3M Company under the trademark PLASTIFORM; another flexible resin permanent magnet material that may be utilized in device 130 for the permanent magnets is made and sold by B. F. Goodrich Company under the trademark KOROSEAL. Yet another such material is available from The Electrodyne Company of Batavia, Ohio under the designation PLASTALLOY for material with a moderate induction level; similar material with a higher induction level (maximum energy product is sold by that company under the designation REANCE 90. The preferred wire size for coil 143 ranges from 38 to 44 gauge copper wire. Larger wire sizes result in better high frequency response. For core 141, No. 1008 steel is satisfactory.

The electromechanical musical pickup 130 of FIGS. 4–6 produces a rather surprisingly high amplitude output signal, usually three to four times the amplitude obtainable with previously known pickups, particularly guitar. pickups. Although there is no external ferromagnetic shield around pickup 130, it exhibits an excellent signal-to-noise ratio. Some hum pickup from external sixty Hertz fields and the like is present but it is low enough so that the output signal from coil 143 is not unduly distorted. All of the materials employed in pickup 130 are commercially available, although coil 143 is usually wound to a particular specification and the dimensions of the core laminations must also be established. Typically, the laminations of core 141, in a guitar pickup, may have a length L of 2.22 inches (5.64 cm), a height of 0.34 inch (0.86 cm) and a thickness of 0.02 to 0.025 inch (0.125 cm). Typically, the permanent magnet layers are No. 1008 steel, approximately 0.03 inch (0.075 cm) in thickness.

Some modifications of the specific pickup construction illustrated in FIGS. 4–6 can be carried out, with but minor degradation of the output signal. In particular, the two side shield magnets 144 and 145 can be eliminated and pickup 130 will continue to operate in a manner similar to that obtained when those shield magnets are present. However, noise or hum in the output signal from coil 143 is likely to be increased if these two side magnets are not present, and amplitude may be reduced somewhat. It will be recognized that the three layer stack shown for permanent magnet 146 is employed primarily because the preferred material to be utilized for these permanent magnets is commercially available in thin sheets but not in thicker sheets or blocks. Thus, a single structure may readily be utilized for the main permanent magnet 146, if and when the material is commercially available.

Figure 7:
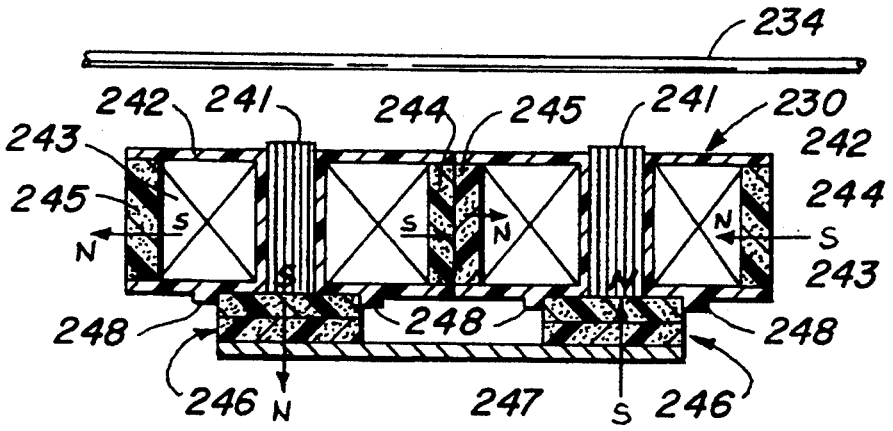
FIG. 7 is a transverse sectional view, like FIG. 6, of a two-coil humbucker pickup using a construction similar to the one-coil pickup of FIGS. 4–6.

FIG. 7 illustrates another electromagnetic musical pickup 230 constructed in accordance with the invention, in a view similar to FIG. 6 but omitting the housing. In many respects pickup 230 of FIG. 7 is a dual coil or "humbucker" version of the construction illustrated in FIGS. 4–6. Thus, it includes two laminated ferromagnetic cores 241 on which two coil forms 242 are mounted. There are two electrical pickup coils 243 in pickup 230. In each side of the humbucker pickup 230 there are two elongated permanent magnets 244 and 245, used as shield magnets and each mounted in the outer portion of the coil form 242 for one side of the pickup. The permanent magnets 244 and 245 in the left-hand side of pickup 230, as seen in FIG. 7, are both magnetized transversely so that the surfaces of the permanent magnet shields facing the coil 243 on this side of the pickup each present a continuous south pole facing toward the coil. The construction is the same but the polarization of the permanent magnets is opposite on the right-hand side of humbucker pickup 230, so that the coil 243 on this side of the device faces a north pole for each of its shield magnets 244, 245.

Immediately below each of the laminated sheet steel cores 241 in pickup 230, FIG. 7, there is a permanent magnet 246. Permanent magnets 246 are shown as each comprising two layers of permanent magnet material. They could be three layers as shown in FIG. 6 or, when thicker permanent magnet material is available, each of the permanent magnets 246 may be of unitary, integral construction. The permanent magnet 246 at the left-hand side of pickup 230 is magnetized to present a continuous south pole on the upper surface of the magnet that engages the lower longitudinal edge of the core 241 at this side of the pickup. The other main permanent magnet 246, at the right-hand side of pickup 230, is of similar construction but is magnetized so that its upper surface, engaging the lower edge of the associated core 241, is a north pole. A single sheet steel member 247 extends across the bottom of the pickup, interconnecting the two permanent magnets 246. Coil bobbins 242 may be provided with depending projections 248 to facilitate alignment of magnets 246 with their associated laminated cores 241.

With coils 243 connected to each other in a conventional coplanar humbucker configuration, as shown, the signal-to-noise ratio of pickup 230 is high and there is virtually no hum in the output signal from the pickup coils 243. The desired signal output from device 230, however, produced by vibration of one of the ferromagnetic strings 234 in the magnetic field of the pickup, is appreciably higher in amplitude than with conventional humbucker pickups. Indeed, an increase in amplitude of three to four times is readily realized. Moreover, pickup 230 is protected against internal vibrational feedback and microphone effects by the auxiliary shield magnets 244 and 245.

A further modification of pickup 230, FIG. 7, entails reversing of one main permanent magnet 246 to have the same polarization as the other main magnet. The outer shield magnet for that same side of the pickup should also be reversed in polarization. The result is a pickup that still has a higher amplitude output and is still protected against vibrational feedback and microphonic effects by shield magnets 244 and 245.

Yet another electromagnetic musical pickup 330, constructed in accordance with a further embodiment of the invention, is shown in FIG. 8, again in a view comparable to that of FIGS. 6 and 7. In pickup 330, which is shown as a humbucker pickup, there are again two elongated laminated ferromagnetic cores 341 each encompassed by a coil form or bobbin 342 with an electrical pickup coil 343 mounted in the bobbin at each side of the pickup. The entire pickup 330 is disposed within a sheet steel casing 347 of U-shaped configuration. Casing 347 may constitute a part of the pickup housing, requiring only a lid (not shown) to enclose the entire pickup. A permanent magnet shield 344 is mounted in the right-hand side of pickup 330, between the vertical wall of casing 347 and coil 343. Similarly, a permanent magnet shield 345 is disposed adjacent to the left vertical wall of casing 347, between the casing and the second coil 343. Permanent magnets 344 and 345 are polarized so that magnet 344 presents a continuous south pole face to coil 343, whereas permanent magnet 345 presents a continuous north pole face immediately adjacent its coil 343.

Figure 8:
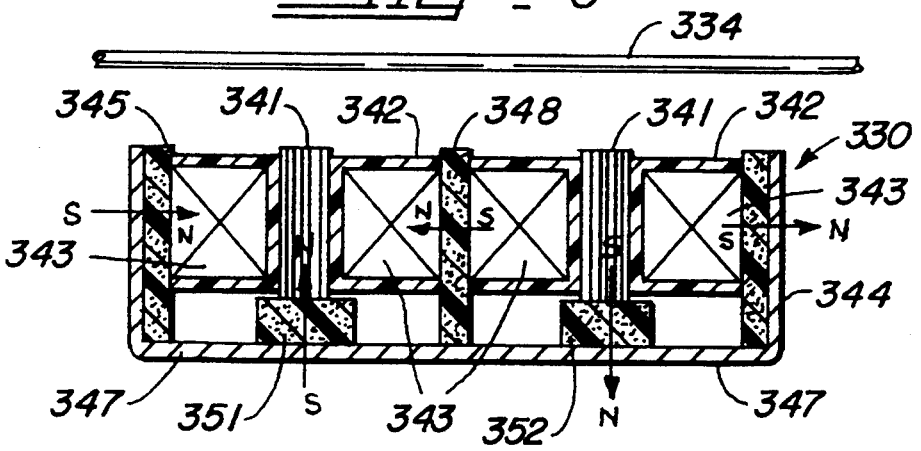
FIG. 8 is a transverse sectional view of another two-coil humbucker embodiment of the invention.

Pickup 330 further comprises two main permanent magnets 351 and 352 in the base of the pickup. Permanent magnet 351 is located at the left-hand side of the pickup, as shown in FIG. 8, immediately below the laminated ferromagnetic core 341 at the left-hand side of the pickup. This permanent magnet 351 is polarized,-.as shown, to present a north pole surface engaging the lower surface of core 341. Permanent magnet 352 is similar except that it engages the other laminated core 341 at the right-hand side of the pickup 330 and presents a continuous south pole surface in engagement with that core. Thus, pickup 330 is a "humbucker" pickup.

At the center of pickup 330 there is one more permanent magnet 348. This permanent magnet is magnetized transversely to present a continuous north pole facing toward the left-hand half of the pickup and a continuous south pole facing the right-hand portion of the pickup.

Like the previously described dual coil humbucker pickup of FIG. 7, humbucker pickup 330 of FIG. 8 generates a high amplitude output signal from its interconnected coils 343. If those two coils are connected in the usual humbucker configuration so that they cancel extraneous hum or noise, the output signal developed in response to vibration of any of the ferromagnetic strings 334 is of substantial amplitude but has little or no hum content. The signal-to-noise ratio is excellent. As in the case of the pickup shown in FIG. 7, the auxiliary or shield permanent magnets 344, 345 and 348 shielding the two coils 343 of the pickup.

Figure 9:
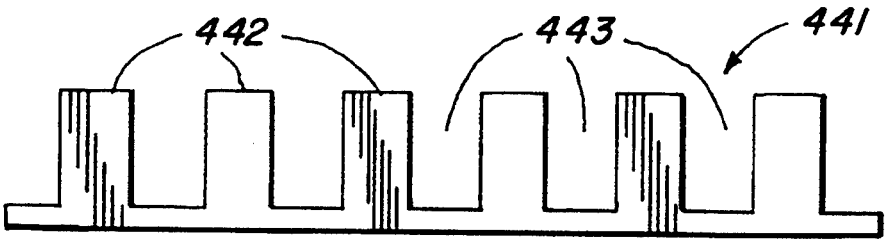
FIG. 9 is a detail elevation view of a modified core lamination usable in any embodiment of the invention.

FIG. 9 illustrates a different construction that may be utilized for the laminations of the core or cores in any of the previously described embodiments. The core lamination 441 shown in FIG. 9 comprises six vertical projections 442 spaced from each other by depressions 443. There should be at least one projection 442 for each string of the musical instrument and each projection 442 is separated from the next such projection by one of the spaces 443. With the core construction built up of laminations like the lamination 441 of FIG. 9, the output signal amplitude remains high and the frequency response or tone is modified to some extend, becoming somewhat "sharper". Otherwise, performance is as previously described.

For all embodiments of the invention the parameters of individual components referred to in connection with FIGS. 4–6 are preferred. The permanent magnet materials with high energy product (BxH) referred to above, when used in the main magnets, enhance and improve output amplitude. Of course, the dual coil construction described for FIG. 8 can be reduced to a single coil pickup like that of FIGS. 4–6, with a steel housing around the one coil.

I claim:

1. An electromagnetic pickup for a musical instrument, such as a guitar, having a plurality of ferromagnetic strings disposed in co-planar spaced relation to each other over a predetermined span S, the pickup comprising:

an elongated ferromagnetic core, having a length L larger than S and a height smaller than S, the core including an assembly of a plurality of at least four thin sheets of ferromagnetic material aligned with each other;

an electrical pickup coil disposed in encompassing relation to the core;

main permanent magnet means including a main permanent magnet disposed in engagement with one elongated edge of the core and magnetized in a direction parallel to the height of the core, for maintaining a given constant polarity in the core;

and housing means, encompassing the core, the coil, and the permanent magnet means, for mounting the pickup in the musical instrument with the core and coil spanning the ferromagnetic strings in spaced relation thereto and with the strings passing through a constant magnetic field afforded by the main permanent magnet and the core so that movement of any string generates an electrical signal in the coil.

2. An electromagnetic pickup for a plural ferromagnetic string musical instrument, according to claim 1, in which the core includes at least six ferromagnetic sheet steel laminations each having a thickness no greater than 0.025 inch (0.06 cm ).

3. An electromagnetic pickup for a plural ferromagnetic string musical instrument, according to claim 1, and further comprising:

first and second shield permanent magnets, disposed along opposite sides of the pickup, each shield magnet having a predetermined length, width, and thickness, with its thickness much smaller than its length or width, each shield permanent magnet being magnetized transversely of its thickness and presenting a surface, facing the pickup coil, having the same polarity as the polarity of the main permanent magnet engaging the edge of the core.

4. An electromagnetic pickup for a plural ferromagnetic string musical instrument, according to claim 3, in which the core includes at least six ferromagnetic sheet steel laminations each having a thickness no greater than 0.025 inch (0.06 cm).

5. An electromagnetic pickup for a plural ferromagnetic string musical instrument, according to claim 1, in which the electrical pickup coil is formed of 44 gauge or larger copper wire.

6. An electromagnetic pickup for a plural ferromagnetic string musical instrument, according to claim 1, in which the coil is mounted in an elongated molded plastic coil form having a central aperture that fits over the core, with the portion of the coil form on each side of the core of squared-off C-shaped configuration, the coil form including two integral alignment elements projecting thereform to align the main permanent magnet immediately below the core.

7. A dual coil electromagnetic pickup for a musical instrument, such as a guitar, having a plurality of ferromagnetic strings disposed in co-planar spaced relation to each other over a predetermined span S, the pickup comprising:

first and second elongated ferromagnetic cores, each core having a length L larger than S and a height smaller than S, each core including an assembly of a plurality of at least four thin sheets of ferromagnetic material aligned with each other;

first and second electrical pickup coils, each disposed in encompassing relation to one of the cores;

first and second permanent magnet means, each including a main permanent magnet disposed in engagement with one elongated edge of one of the cores and magnetized in a direction parallel to the height of its associated core, for maintaining a given constant polarity in the associated core;

and housing means, encompassing cores, coils, and the permanent magnet means, for mounting the pickup in the musical instrument with each core and coil spanning the ferromagnetic strings in spaced relation thereto and with the strings passing through constant magnetic fields afforded by each of the main permanent magnets and the cores so that movement of any string generates an electrical signal in both of the coils.

8. A dual-coil electromagnetic pickup for a plural ferromagnetic string musical instrument, according to claim 7, and further comprising a ferromagnetic plate engaging and interconnecting the surfaces of the main permanent magnets farthest displaced from the cores.

9. A dual-coil electromagnetic pickup for a plural ferromagnetic string musical instrument, according to claim 7, in which each core includes at least six ferromagnetic sheet steel laminations, each lamination having a thickness no greater than 0.025 inch (0.06 cm).

10. A dual-coil electromagnetic pickup for a plural ferromagnetic string musical instrument, according to claim 7, and further comprising:

first and second shield permanent magnets, disposed along opposite sides of the pickup, each shield magnet having a predetermined length, width, and thickness, with its thickness much smaller than its length or width, each shield permanent magnet being magnetized transversely of its thickness and presenting a surface, facing its associated pickup coil, having the same polarity as the polarity of the main permanent magnet engaging the edge of the core encompassed by that coil.

11. A dual-coil electromagnetic pickup for a plural ferromagnetic string musical instrument, according to claim 10, and further comprising:

a third shield permanent magnet, interposed between the coils and magnetized transversely to present a surface facing each coil that has the same polarity as the polarity of the main permanent magnet engaging the edge of the core encompassed by that coil.

12. An electromagnetic pickup for a plural ferromagnetic string musical instrument, according to claim 7, in which the polarities of the first and second main permanent magnets are oriented oppositely to each other.

* * * * *